US005390680A

United States Patent [19]

Brenner

[11] Patent Number: 5,390,680

[45] Date of Patent: Feb. 21, 1995

[54] METHOD OF AND DEVICE FOR TAKING LIMB IMPRESSIONS

[76] Inventor: Edeltraud Brenner, Gartenstrasse 22a, 89257 Illertissen, Germany

[21] Appl. No.: 162,643

[22] Filed: Dec. 3, 1993

[30] Foreign Application Priority Data

Oct. 28, 1993 [DE] Germany ..... 16515[U]

[51] Int. Cl.[6] ..... A61B 5/117

[52] U.S. Cl. ..... 128/779; 33/515

[58] Field of Search ..... 128/774, 779, 777, 782; 33/511-512, 515; 427/1

[56] References Cited

U.S. PATENT DOCUMENTS

| | | | |
|---|---|---|---|
| 1,170,273 | 2/1916 | Jorgensen | 427/1 |
| 1,237,277 | 8/1917 | Bauder | 427/1 |
| 3,720,304 | 3/1973 | Laugherty et al. | 427/1 X |
| 4,706,600 | 11/1987 | Mason, Jr. et al. | 427/1 X |
| 4,939,852 | 7/1990 | Brenner . | |

FOREIGN PATENT DOCUMENTS

| | | | |
|---|---|---|---|
| 2615092 | 11/1988 | France | 128/779 |
| 3711539 | 10/1988 | Germany | 128/779 |
| 9104534 | 7/1991 | Germany . | |
| 0091284 | 4/1988 | Japan | 427/1 |
| 3080833 | 4/1991 | Japan | 427/1 |
| 0005251 | of 1915 | United Kingdom | 427/1 |

*Primary Examiner*—Angela D. Sykes
*Attorney, Agent, or Firm*—Herbert Dubno

[57] ABSTRACT

An impression of a limb, for example, a foot, can be taken, e.g. for mail order or catalog sales and shoes, shoe inserts and the like without trying on, utilizing a transparent pouch, one inner wall of which has an adhesive layer separated by a silicone foil from a single-use carbon-paper sheet which is attached to a cover sheet within the pouch. Upon withdrawal of the silicone-coated layer, the foot can be pressed against the other wall of the pouch and the cover sheet to transfer carbon coating from the carbon-paper sheet to the adhesive whereupon the cover sheet and single-use carbon-paper sheet can be extracted from the pouch. The transferred imprint on the adhesive layer is protected within the pouch.

6 Claims, 1 Drawing Sheet

METHOD OF AND DEVICE FOR TAKING LIMB IMPRESSIONS

FIELD OF THE INVENTION

The present invention relates to a method of and to a device for taking impressions of body portions, especially limbs and, more specifically, to a method of and device for the taking of such impressions for use in mail order and catalog sales of shoes, shoe inserts, gloves and the like.

BACKGROUND OF THE INVENTION

For a variety of purposes it is known to make an impression of one or more limbs of the human body, for example, the foot or feet of an individual. With aid of such an impression, which can be referred to as a footprint, for example, it is possible to select a shoe or produce a shoe to fit the subject without the need for a series of trial fittings. The same applies, of course, to the creation or selection of shoe inserts which can be designed or selected for the particular size and shape of the footprint of the individual without requiring special fittings or the like.

Mention should also be made of the fact that impressions can be advantageous for other limbs of the body, for example, the hand, for the selection of gloves, e.g. in the case of children who are difficult to fit and often will not tolerate fittings well. It is with the production of such impressions that the invention is concerned and particularly with the method of making such impressions and a device for that purpose which will enable practically any person to make an impression, e.g. a footprint, which can be used in mail order sales or procurement of shoes or shoe inserts without assistance and with a minimum of effort.

Of course there are already devices which will allow a footprint to be produced for this purpose. One such device utilizes a piece of cardboard and a paper provided with a layer of a blue dye which will transfer under pressure to the cardboard upon moistening of the latter. To form the print, the cardboard must be moistened to a proper degree, the print paper must be applied to the cardboard and the foot pressed against the reverse side of the blue paper until the impression appears on the moistened cardboard.

This system has drawbacks for the average consumer since numerous steps are required which are not always performed with the requisite precision. Frequently, for example, the cardboard is not moistened sufficiently or is moistened excessively so that a satisfactory impression cannot be taken. Furthermore, the user is readily soiled or the clothes of the user can be soiled with the blue dye. As a result this technique requires a somewhat significant degree of dexterity and skill.

In a system in which the color layer is bonded to a foil which must be stripped away for the impression and then reapplied to prevent damage to the impression, handling is somewhat difficult, especially for the unskilled user and there is always a danger of soiling of the user or his or her garment.

OBJECTS OF THE INVENTION

It is the principal object of the present invention to provide a device for taking impressions of the type described which can be used by an average consumer without special skills to provide an accurate impression, especially of the foot but also for any other limb of the body and which can be used for the production or selection of shoes or shoe inserts of appropriate size and configuration, especially for mail order or catalog sale purposes.

It is another object of this invention to provide a device for taking impressions of the limbs of a human body which is especially simple to use, is flat and convenient for transmission through the mails to the potential user and for transmission by the user to the source of an article to be sized in accordance with the impression.

It is also an object of this invention to provide a device for taking impressions for the purposes described which will minimize the possibility of soiling of the user or his or her garments.

Still another object of the invention is to provide an improved method of taking an impression whereby drawbacks of earlier systems can be avoided.

SUMMARY OF THE INVENTION

These objects are attained, in accordance with the invention, by providing a device which utilizes a pouch or pocket of transparent material, which also may be referred to herein as an envelope and which is open at one side or end and has an inner surface which is coated with an adhesive. Preferably this adhesive has an affinity to the carbon coating of a single-use carbon paper sheet which will be described in greater detail and can adhere the coating to it upon the application of pressure. For this purpose the adhesive may have a certain degree of tackiness and may be a pressure adhesive or pressure-sensitive adhesive of the type utilized in the pressure bonding of paper together in masking tape, transparent tapes or the like. The term "pressure-sensitive adhesive" has been used to designate these commercially-available adhesive types. According to the invention, within the pouch or pocket there are provided, at the side opposite the adhesive layer, a cover sheet whose inner edge is connected to a single-use carbon-paper sheet whose carbon coating is disposed opposite the adhesive layer. A silicone-coated foil is disposed between the carbon-paper sheet and the adhesive layer of the pouch.

When, therefore, this foil is withdrawn from the open side of the pouch from between the adhesive layer and the carbon-coated sheet, an impression of the carbon-coated paper against the adhesive layer will result in transfer of the coloring material to the adhesive layer so that, upon withdrawal of the cover sheet and the carbon paper from the pouch, the impression or imprint will be left therein on the adhesive layer protected by the opposite transparent wall of the pouch.

According to a feature of the invention, the cover sheet and the carbon-paper sheet may be a single folded sheet having a carbon coating on one portion thereof with the two portions connected by a fold at the inner end of the pouch. This construction renders superfluous the need to bond the carbon-paper sheet to the cover sheet.

Instead of a single leaf of the silicone-coated foil, a double foil can be provided with one portion juxtaposed with the adhesive layer and another portion juxtaposed with the carbon-paper sheet, the two portions being connected by a common fold. The portion juxtaposed with the carbon-paper sheet may have a flap or end projecting from the open side of the pouch so that it can be readily gripped by the user to permit the withdrawal of the foil preparatory to the taking of the impression.

With the device of the invention, therefore, the impression is taken by first withdrawing the foil from between the carbon-paper sheet and the adhesive layer on the back wall of the pouch, then placing the pouch upon a rigid surface and pressing against the opposite wall of the pouch and the cover sheet to press the carbon-paper sheet against the adhesive. Once the pressure of the foot against the pouch has caused the carbon-paper sheet to contact the adhesive layer, the cover sheet is then withdrawn from the open end pouch, thereby rolling the carbon-paper sheet off the adhesive layer and withdrawing it from the pouch.

When this process is completed, there remains only the transparent pouch on an inner wall of which is a visible imprint of the pattern of the foot which pressed against the pouch.

Since the user, as a practical matter does not come into contact with the carbon-paper sheet at all and by the rolling action with which the carbon-paper sheet is withdrawn from the pouch, it tends to roll up after the cover sheet. Removed into a roll with a maximum diameter of 1 cm, there is little carbon-coating area for contact with the user. A soiling of the user or the clothes of the user is practically foreclosed. Another important advantage of the invention is that at the end of the process, the impression or imprint is fully contained in a pouch of transparent material so that there is no danger that the imprint will be damaged or lost. The user need only mail or otherwise transmit the imprint pouches with the foot imprints to the supplier of the shoes or shoe inserts so that shoes or inserts can be fabricated or selected to fit.

Mention may be made of German Utility Model G 91 04 534.7 which does disclose a device which comprises a first cover sheet, a color foil lying therebeneath and enclosed in a protective envelope and an impression sheet therebelow for receiving the impression, and finally a second cover sheet beneath this stack in the nature of a conventional carbon-paper set or manifold set utilized in offices and the like for multiple copies. While this device for taking impressions has proved satisfactory to some degree, it is of complex construction and cannot provide the advantage that the impression, once made, is fully protected for direct transmission by mail or the like as is the case with the impression of the present invention.

The device of the invention can thus comprise:

- a generally flat pouch having at least one flexible transparent side, an opening at one end and another side opposite the one side;
- a layer of a pressure-sensitive adhesive on an inner surface of the other side;
- a cover sheet in the pouch disposed proximal to the flexible transparent side;
- a single-use carbon paper sheet affixed to the cover sheet at an end thereof opposite the one end and juxtaposed with the layer of adhesive between the cover sheet and the layer of adhesive; and
- a silicone-coated foil interposed between the carbon paper sheet and the layer of adhesive in the pouch and extractable from the pouch to permit an impression applied to the flexible transparent side and the cover sheet to imprint upon the adhesive layer.

In specific steps, the method comprises:

(a) providing a generally flat pouch having at least one flexible transparent side, an opening at one end and another side opposite the one side, a layer of a pressure-sensitive adhesive on an inner surface of the other side, a cover sheet in the pouch disposed proximal to the flexible transparent side, a single-use carbon paper sheet affixed to the cover sheet at an end thereof opposite the one end and juxtaposed with the layer of adhesive between the cover sheet and the layer of adhesive, and a silicone-coated foil interposed between the carbon paper sheet and the layer of adhesive in the pouch and extractable from the pouch to permit an impression applied to the flexible transparent side and the cover sheet to imprint upon the adhesive layer;

extracting the foil from the pouch through the one end to directly position the carbon-paper sheet opposite the adhesive layer;

with the other side of the pouch resting upon a substantially rigid surface, pressing a limb against the flexible transparent side of the pouch and the cover sheet, thereby pressing the carbon-paper sheet against the adhesive layer in a pattern of the limb; and then pulling the cover sheet out of the pouch to thereby separate the carbon-paper sheet from the adhesive layer and withdrawing the carbon-paper sheet with the cover sheet from the pouch, thereby leaving an imprint of the pattern on the other side of the pouch.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
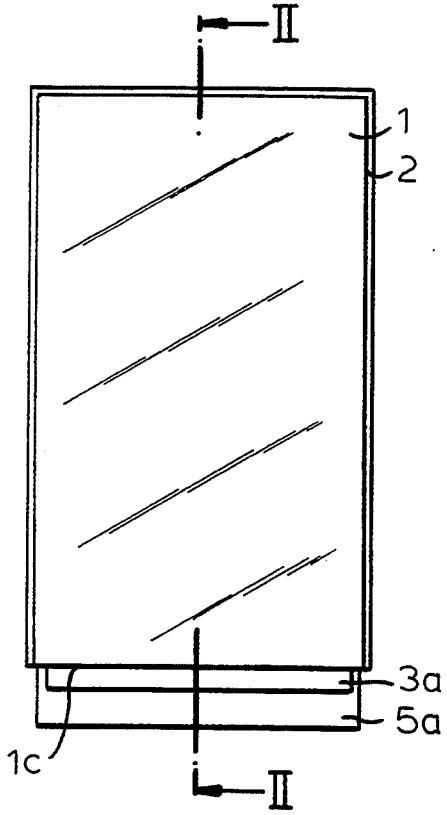
FIG. 1 is a plan view of a pouch provided with the sheets of the invention.
Figure 2:
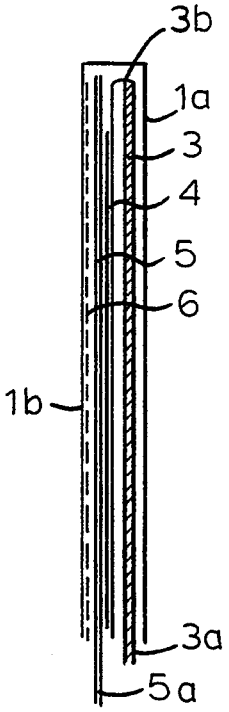
FIG. 2 is a diagrammatic section taken a long the line II—II of FIG. 1.

In FIGS. 1 and 2 I have shown an embodiment of the device for taking an impression, especially of a foot of the user which comprises a pouch 1 of transparent material having a transparent wall 1*a* and another wall 1*b* which may also be transparent and is internally coated with a pressure-sensitive adhesive 6.

In the pouch there is provided a silicone-coated foil 5 which serves as a mask for the adhesive layer 6 and prevents contact of that adhesive layer with a carbon-paper sheet 4 whose carbon-coated surface is turned toward the adhesive layer 6.

The pouch 1 which is open at its end 1*c*, contains in addition a cover sheet 3 which may be composed of paper and may be printed on its surface visible through the transparent wall 1*a* with instructions as to the use of the device.

At its end turned toward the open side 1*c* of the pouch, the cover sheet 3 may have a flap 3*a* or edge which projects from this pouch to enable it to be gripped by the user at the appropriate time.

At its opposite end 3*b*, the cover sheet 3 is attached, e.g. by an adhesive, to the carbon paper sheet 4 which is disposed between the cover sheet 3 and the foil 5. The carbon-paper sheet is a single-use carbon paper which may be of a much thinner material than the cover sheet 3. Indeed, the carbon-paper sheet 4 may be a thin carbon-paper foil capable of readily rolling up when pulled from the pouch. The cover sheet 3 may be a heavier paper forming a cushion for the foot.

Figure 3:
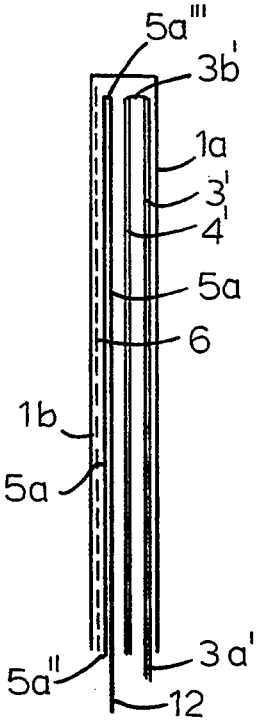
FIG. 3 is a cross sectional view similar to FIG. 2 but illustrating another embodiment.

In FIGS. 2 and 3 of the drawing, the spread of the layers has been exaggerated and the pouch has been shown to be of greater thickness than is conventional so that the various layers can be clearly illustrated. In practice, of course, the various layers will lie against one another and will be of relatively small thickness.

The impression is taken with the device of FIGS. 1 and 2 as follows. Initially the silicone-coated foil 5, which may have a flap or extension 5*a* projecting out of the open side 1*c* of the pouch 1, is pulled out of the pouch from between the single-use carbon-paper sheet 4 and the adhesive 6.

The back wall 1*b* of the pouch is then placed upon a rigid support, e.g. the ground, a wood floor or other noncarpeted surface and the user presses with his full weight against the transparent pouch wall 1*a*, preferably over an outline of the cover sheet 3 visible through this transparent wall.

Figure 4:
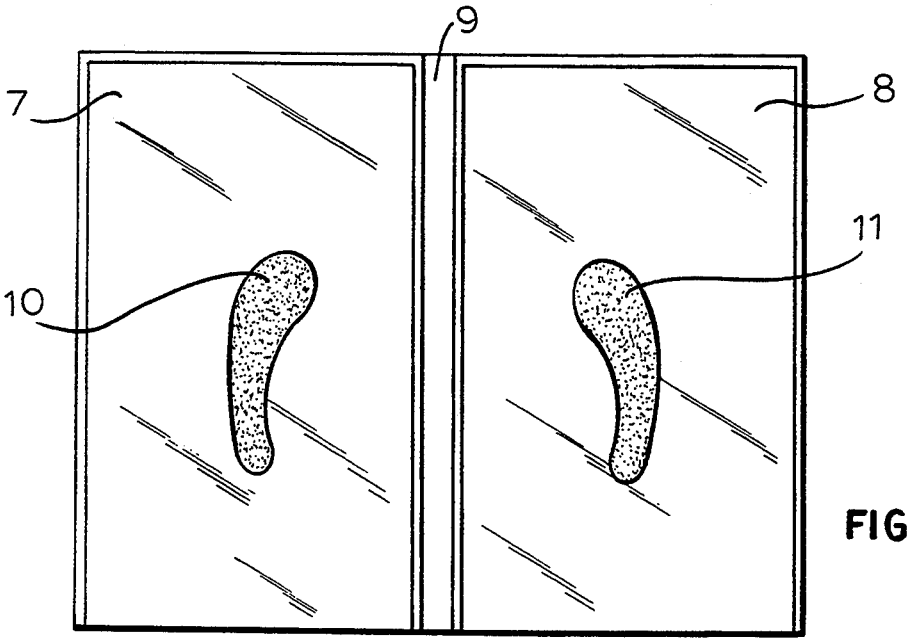
FIG. 4 is a view of a double-pouch structure according to the invention after the impressions of two feet have been taken.

Then the user pulls on the cover sheet 3 via the flap or projecting end 3*a* to roll the carbon-paper sheet 4 off the adhesive layer 6 against which it has been pressed, to leave the carbon coating of the carbon-paper sheet attached to the adhesive wherever the local pressure of the foot was applied. The fact that the carbon-paper sheet is a thin foil causes it to roll up on the end of the paper sheet 3 to which it is affixed at 3*b*. The silicone-foil paper 5 and the paper sheet 3 which has a depleted carbon-paper sheet 4 attached thereto can then be disregarded. An impression or imprint from the transferred carbon-paper coating of the foot remains on the adhesive layer 6 and is fully protected in the transparent pouch. The traces 10 and 11 of two feet are shown through the transparent wall of the pouches 7 and 8 which are connected together by a web 9 along longitudinal edges of the pouch in the embodiment of FIG. 4, showing the device after the impressions of the left and right feet have been taken.

In the cross sectional view of FIG. 3 it can be seen that instead of a single-layer foil 5, the foil can be doubled at 5*a* to have one portion 5*a*′ turned toward the adhesive, another portion 5*a*″ turned toward the carbon paper sheet and a fold 5*a*‴ at the end remote from a projecting portion 12 forming a flap which can be pulled by the user to withdraw the silicone-coated foil 5*a* from the pouch.

In this embodiment as well, the cover-sheet portion 3′ and the carbon-paper portion 4′ are formed as portions of a single sheet connected by a fold 3*b*′. At the end opposite the portion 3*a*′ projects from the pouch and by means of which the cover sheet and the carbon-paper sheet are withdrawn. Of course the device of FIG. 3 is operated in the same manner as the device of FIGS. 1 and 2.

I claim:

1. A device for obtaining an impression of a limb of the body, comprising:

at least one generally flat pouch having at least one flexible transparent side, an opening at one end and another side opposite said one side;

a layer of a pressure-sensitive adhesive directly coated on an inner surface of said another side of said pouch;

a cover sheet in said pouch disposed proximal to said flexible transparent side;

a single-use carbon paper sheet affixed to said cover sheet at an end thereof opposite said one end to form a continuous band from said sheets, said single-use carbon paper sheet being juxtaposed with said layer of adhesive between said cover sheet and said layer of adhesive, said band being extractable from said pouch through said opening; and a silicone-coated foil interposed between said carbon paper sheet and said layer of adhesive in said pouch and extractable from said pouch to permit an impression applied to said flexible transparent side and said cover sheet to imprint upon said adhesive layer prior to extraction of said band from said pouch, whereby an imprint on said layer is protected in said pouch.

2. The device defined in claim 1 wherein said carbon-paper sheet and said cover sheet are separate sheets secured together at said opposite end along edges of said separate sheets.

3. The device defined in claim 1 wherein said cover sheet and said carbon paper sheet are formed unitarily with one another from a single folded leaf coated with a carbon-paper coating on one side.

4. The device defined in claim 1 wherein said silicone-coated foil is a doubled sheet having one portion juxtaposed with said adhesive layer and another portion juxtaposed with said carbon-paper sheet and connected with said one portion by a fold, said another portion projecting from said one end of said pouch to enable said doubled sheet to be withdrawn therefrom.

5. The device defined in claim 1 wherein two of said pouches are attached side by side along a longitudinal edge to take impressions of two limbs.

6. A method of taking an impression of a limb, comprising the steps of:

(a) providing a generally flat pouch having at least one flexible transparent side, an opening at one end and another side opposite said one side, a layer of a pressure-sensitive adhesive on an inner surface of said another side, a cover sheet in said pouch disposed proximal to said flexible transparent side, a single-use carbon paper sheet affixed to said cover sheet at an end thereof opposite said one end and juxtaposed with said layer of adhesive between said cover sheet and said layer of adhesive, and a silicone-coated foil interposed between said carbon paper sheet and said layer of adhesive in said pouch and extractable from said pouch to permit an impression applied to said flexible transparent side and said cover sheet to imprint upon said adhesive layer;

extracting said foil from said pouch through said one end to directly position said carbon-paper sheet opposite said adhesive layer;

with said other side of said pouch resting upon a substantially rigid surface, pressing a limb against said flexible transparent side of said pouch and said cover sheet, thereby pressing said carbon-paper sheet against said adhesive layer in a pattern of the limb; and then pulling said cover sheet out of said pouch to thereby separate said carbon-paper sheet from said adhesive layer and withdrawing said carbon-paper sheet with said cover sheet from said pouch, thereby leaving an imprint of the pattern on said other side of said pouch.

* * * * *